US006311387B1

(12) United States Patent
Shikama et al.

(10) Patent No.: US 6,311,387 B1
(45) Date of Patent: Nov. 6, 2001

(54) METHOD OF MANUFACTURING INDUCTOR

(75) Inventors: Takashi Shikama, Yokaichi; Masami Sugitani, Omihachiman; Hisato Oshima, Yokaichi, all of (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/324,745

(22) Filed: Jun. 3, 1999

(30) Foreign Application Priority Data

Jun. 5, 1998 (JP) ..... 10-173864

(51) Int. Cl.[7] ..... H01F 7/06; H01F 17/06

(52) U.S. Cl. ..... 29/602.1; 29/605; 29/608; 29/606; 336/192; 336/223; 336/175

(58) Field of Search ..... 29/602.1, 592.1, 29/605, 606, 608; 336/8.3, 96, 192, 233, 175, 172

(56) References Cited

U.S. PATENT DOCUMENTS

| | | | | |
|---|---|---|---|---|
| 4,268,003 | | 5/1981 | Liautaud | 249/142 |
| 5,307,557 | | 5/1994 | Te Hsueh | 29/605 |
| 5,551,146 | | 9/1996 | Kawabata et al. | 29/608 |
| 5,767,759 | | 6/1998 | Rouet | 336/174 |
| 5,903,207 | | 5/1999 | Lampe, Jr. et al. | 336/192 |
| 6,063,321 | | 5/2000 | Koyama et al. | 264/404 |
| 6,189,204 | * | 2/2001 | Shikama et al. | 29/608 |
| 6,242,995 | * | 6/2001 | Shikama et al. | 336/175 |

FOREIGN PATENT DOCUMENTS

| | | | | |
|---|---|---|---|---|
| 6120039 | | 4/1984 | (JP) | 29/602.1 |
| 1-253906 | | 10/1989 | (JP) . | |
| 5299250 | | 11/1993 | (JP) | 29/602.1 |
| 5304035 | | 11/1993 | (JP) | 29/602.1 |
| 684648 | | 3/1994 | (JP) | 29/606 |
| 411354364-A | * | 12/1999 | (JP) . | |
| 2000106315 | | 4/2000 | (JP) . | |
| 02000106314-A* | | 4/2000 | (JP) . | |

* cited by examiner

*Primary Examiner*—Lee Young
*Assistant Examiner*—Minh Trinh
(74) *Attorney, Agent, or Firm*—Keating & Bennett, LLP

(57) ABSTRACT

A method of manufacturing a bead inductor prevents deformation of a metal coil or dislocation of the axis position of the metal coil caused by injection pressure at the time of injecting a molten resin material from a gate. A coil is fitted onto a coil supporting pin provided on a first lower mold used for injection molding in a cavity of the mold such that the inner periphery of the coil is in close contact with the coil supporting pin. A molten, resin material is injected into the cavity. Then, the coil supporting pin and the first lower mold are removed from the molded product, and a second lower mold without a coil supporting pin is provided for replacing the first lower mold. A molten resin material is injected into the space which had been occupied by the coil supporting pin. After removing the hardened resin molded product from the mold for injection molding, the end parts of the coil are cut so as to be exposed.

20 Claims, 11 Drawing Sheets

METHOD OF MANUFACTURING INDUCTOR

BACKGROUND OF THE INVENTION

1. Field of the Invention

The present invention relates to a method of manufacturing an inductor, and more specifically, to a method of manufacturing a chip type inductor to be used a component for suppressing the noise produced by microprocessor or other element which requires a large current.

2. Description of the Related Art

Japanese Unexamined Patent Publication No. 1-253906 discloses a method of injection molding as an example of a conventional method of manufacturing a chip type inductor. A metal coil 30 having a spiral shape is made of a metal conductor as shown in FIG. 1, and the metal coil 30 is set in a cavity 40 of a mold 38 for forming a resin molded product 34 shown in FIG. 2. At the time, the metla coil 30 is placed inside of the cavity 40 such that both ends of the spirally-wound metal coil 30 which are parallel to the axial direction, are forced inside of the cavity 40 of the mold 38. Then, a molten resin containing magnetic powders is injected into the cavity 40 for forming the resin molded product 34. After hardening the injected resin, the resin molded product 34 is removed from the cavity 40. Metal caps 36 are put onto both ends in the longitudinal direction of the resin molded product 34. Both metal caps 36 and the corresponding end parts of the metal coil 30 are electrically connected to a conductive material so as to provide an inductor 32 having the metal caps 36 defining electrodes as shown in FIG. 2. In the above-mentioned method of manufacturing and inductor via injection molding, only both end parts of the metal coil 30 are fixed with the mold 38 until the resin is injected into the cavity 40, such that the middle part of the metal coil 30 is unsupported in the cavity 40. Therefore, this method experiences a problem with deformation and dislocation of the metal coil 30 with respect to the center in the cavity 40 due to the injection pressure at the time of injecting the molten resin from the gate.

SUMMARY OF THE INVENTION

In order to overcome the problems described above, preferred embodiments of the present invention provide a method of manufacturing a coil inductor which prevents metal coil deformation and metal coil dislocation relative to an axis, which are caused by injection pressure at the time of injecting molten resin from a gate. Furthermore, preferred embodiments of the present invention provide a method of manufacturing an inductor via injection molding so as to produce a large number of inductors in a single one operation and so as to greatly improve the operation efficiency of post-production processing.

According to a first preferred embodiment, a method of manufacturing an inductor having a conductor coil embedded in a magnetic chip containing a magnetic material, with an external terminal electrode electrically connected to the conductor coil on the outer surface of the magnetic chip, includes the steps of holding the conductor coil in a cavity by fitting the conductor coil with a pole-shaped coil supporting member provided in the cavity of a mold for injection molding, performing a primary injection molding by injecting a molten magnetic chip molding material into the cavity, performing a secondary injection molding by removing the coil supporting member from the cavity and injecting a molten magnetic chip molding material into the space in the cavity which had been occupied by the coil supporting member, removing the molded product with the conductor coil embedded therein from the mold for injection molding, and cutting the molded product so as to expose the end parts of the embedded conductor coil.

According to the first preferred embodiment, since the conductor coil is embedded in the magnetic chip via injection molding, a chip inductor can be produced easily. Besides, since the injection molding can be conducted with the conductor coil positioned and held by the coil supporting member in the cavity of the mold for injection molding, the conductor coil is embedded at a predetermined position in the molded product so as to enable mass production of inductors with a homogeneous characteristic and an extremely small proportion of defective items. Moreover, since both ends of the molded product are cut after embedding the conductor coil in the magnetic chip, the ends of the embedded conductor coil are easily and reliably exposed.

A second preferred embodiment provides a method of manufacturing an inductor having a conductor coil embedded in a magnetic chip containing a magnetic material, with an external terminal electrode electrically connected to the conductor coil on the outer surface of the magnetic chip includes the steps of holding the conductor coil in a cavity of a coil supporting member, performing a primary injection molding by injecting a molten magnetic chip molding material into the cavity of the coil supporting member, performing a secondary injection molding by removing the molded product with the conductor coil embedded therein from the coil supporting member so as to be placed in the cavity of the mold for injection molding and injecting a molten magnetic chip molding material into the cavity of the mold for injection molding, removing the molded product with the conductor embedded therein from the mold for injection molding, and cutting the molded product so as to expose the end parts of the embedded conductor coil.

According to the second preferred embodiment, since the conductor coil is embedded in the magnetic chip via injection molding, a chip inductor can be produced easily. Besides, since the injection molding can be performed while the conductor coil is positioned and held by the coil supporting member in the cavity of the coil supporting member, the conductor coil is embedded in a predetermined position in the molded product so as to enable the mass production of inductors with a homogeneous characteristic and an extremely small proportion of defective items. Moreover, since both ends of the molded product are cut after embedding the conductor coil in the magnetic chip, the ends of the embedded conductor coil are easily and reliably exposed.

A third preferred embodiment of the present invention provides a method of manufacturing an inductor according to the processes of the first or second preferred embodiments described above, wherein the conductor coil is held by the coil supporting member with at least one end part of the conductor coil being temporarily attached to the conductor coil itself at the time of the primary injection molding.

According to the third preferred embodiment, since at least one end part of the conductor coil is temporarily attached to the coil, the shape of the conductor coil itself can be maintained so that problems, such as the inability of the end of the conductor coil to be bent inward and put through by the coil supporting member, irregularity of the winding diameter of the conductor coil caused by the end of the conductor coil being released by the injection pressure of the molten molding material, and deterioration of the characteristics caused by the irregularity of the winding density, can be prevented so that generation of a defective product is reliably prevented.

A fourth preferred embodiment provides method of manufacturing an inductor according to the first, second or third preferred embodiments, wherein the end parts of the embedded conductor coils are exposed by cutting the molded product and the conductor coils are separated individually after obtaining a molded product with a plurality of the conductor coils insert-molded in the magnetic chip molding material by the primary injection molding and the secondary injection molding.

According to the fourth preferred embodiment, since the molded product having a plurality of the conductor coils insert-molded can be obtained, the manufacturing process is very efficient and greatly improves mass productivity.

A fifth preferred embodiment includes a method of manufacturing an inductor according to the first, second, third or fourth preferred embodiments, wherein the molded product is cut so as to divide the conductor coil having a length suitable for a plurality of components, into a length suitable for one component, after obtaining a molded product with a conductor coil having a length suitable for a plurality of components embedded in the magnetic chip, by the primary injection molding and the secondary injection molding.

According to the fifth preferred embodiment, since the primary injection molding and the secondary injection molding are conducted, using a conductor coil having a length suitable for a plurality of components, a molded product with a plurality of the conductor coils insert-molded can be obtained in a multi-layer unit at one time so that the manufacturing process is extremely efficient and so that mass productivity is greatly improved.

A sixth preferred embodiment includes a method of manufacturing an inductor according to the fifth preferred embodiment, wherein a coil supporting member for holding the conductor coil having a length suitable for a plurality of components is provided in the primary injection molding, and a member for supporting the conductor coil fitted onto the coil supporting member or the coil supporting member is provided at a position to define the cutting margin of the molded product with the conductor coil embedded therein.

According to the sixth preferred embodiment, since a member for supporting the conductor coil fitted onto the coil supporting member or the coil supporting member is provided at a position to define the cutting margin of the molded product with the conductor coil embedded therein, bending of the coil supporting member or the dislocation of the coil supporting member is reliably prevented. Accordingly, the positioning accuracy of the conductor coil embedded in the molded product is greatly improved.

A seventh preferred embodiment includes a method of manufacturing an inductor according to any of the first to sixth preferred embodiments, wherein a marking part for providing a mark indicating the position of the cutting margin of the molded product on the outer surface of the molded product is provided on the inner surface of the cavity of the mold for injection molding.

According to the seventh preferred embodiment, since the marking part is provided inside of the cavity of the mold for injection molding, the target of the cutting position is indicated so that the position to be cut by the slicing machine or the dicing saw can be recognized easily for improving the operation efficiency as well as improving the size accuracy of the molded products.

DETAILED DESCRIPTION OF PREFERRED EMBODIMENTS

In preferred embodiments to be explained below, a bead inductor (chip type inductor) will be described as an example of inductors, however, the present invention is not limited to only bead inductors but applies to any type of inductor and other electronic components.

Hereinafter, a method of manufacturing a bead inductor according to the first preferred embodiment of the present invention will be described with reference to FIGS. 3A to 6B. The method according to preferred embodiments of the present invention is performed via injection molding, but the configuration of an apparatus to be used in the injection molding method commonly used is not illustrated here.

Figure 1:
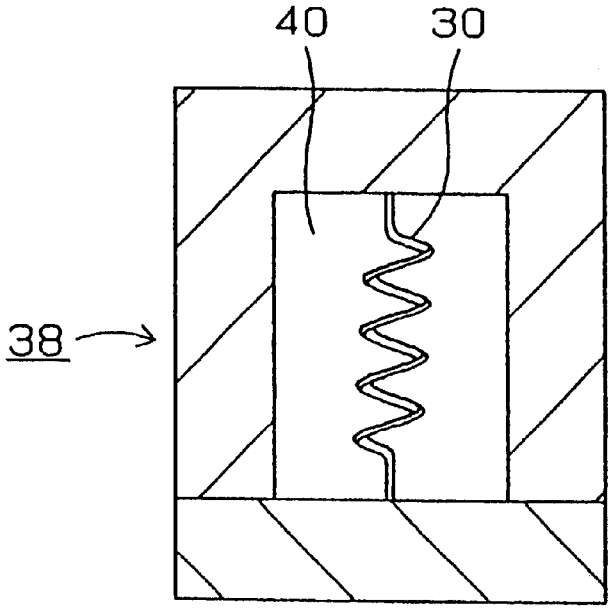
FIG. 1 PRIOR ART
FIG. 1 is a cross-sectional view of a conventional mold used for manufacturing a chip type inductor.
Figure 2:
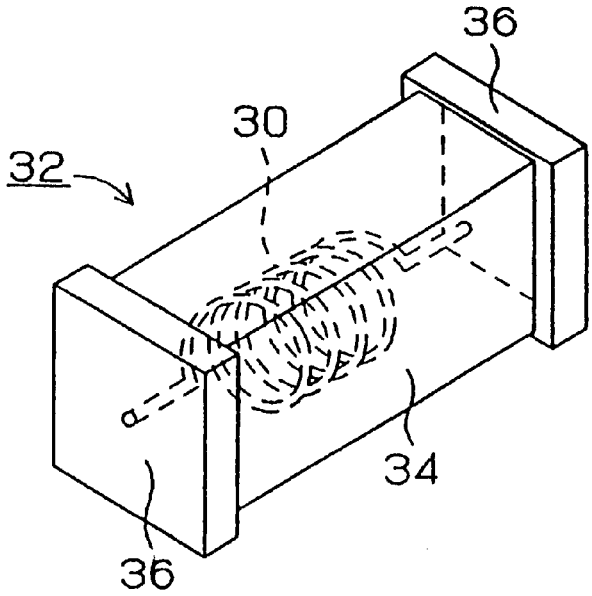
FIG. 2 PRIOR ART
FIG. 2 is a perspective view of a bead inductor produced using the mold shown in FIG. 1.
Figure 3A:
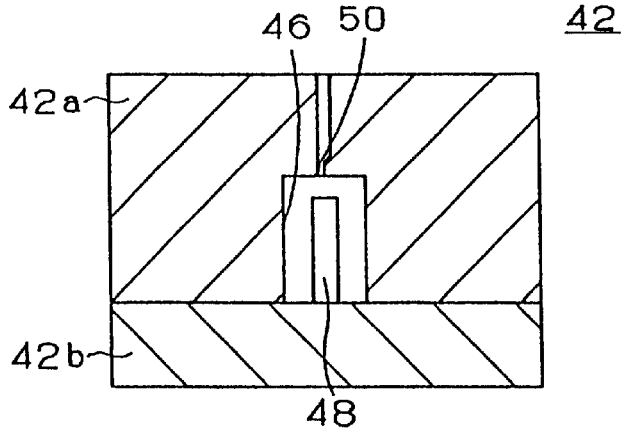
FIG. 3A is a cross-sectional view of a mold for injection molding used in a method according to a first preferred embodiment of the present invention.
Figure 3B:
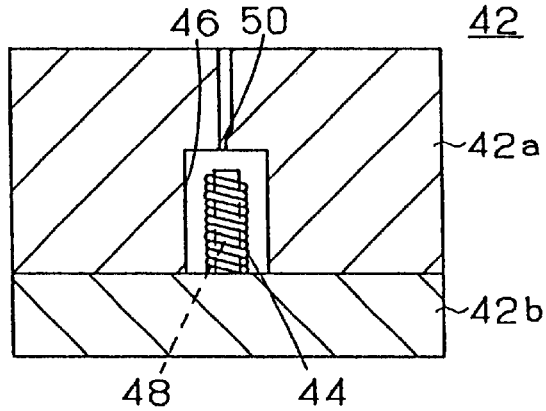
FIG. 3B is a cross-sectional view showing a state in which a coil is placed in the mold shown in FIG. 3A.
Figure 3C:
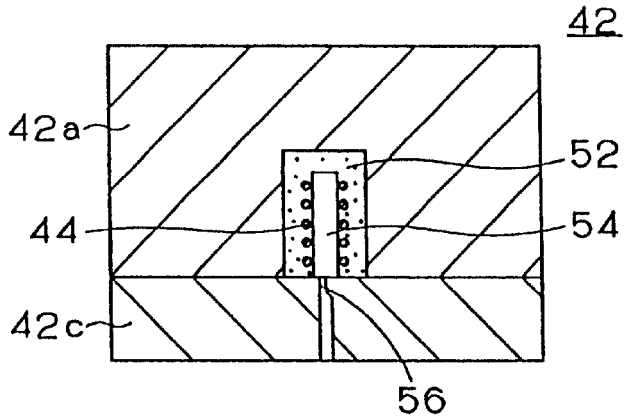
FIG. 3C is a cross-sectional view showing a state after a primary injection molding process.
Figure 3D:
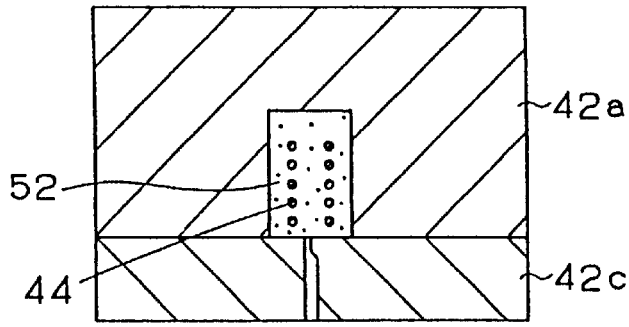
FIG. 3D is a cross-sectional view showing the state after a secondary injection molding process.
Figure 4A:
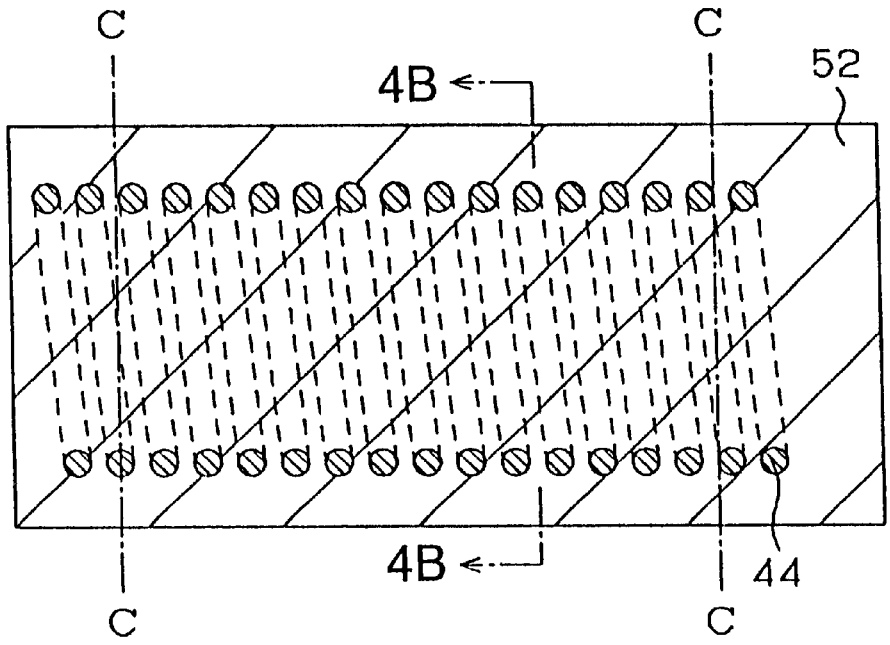
FIG. 4A is a cross-sectional view for explaining the cutting position of a resin molded product according to the first preferred embodiment of the present invention.
Figure 4B:
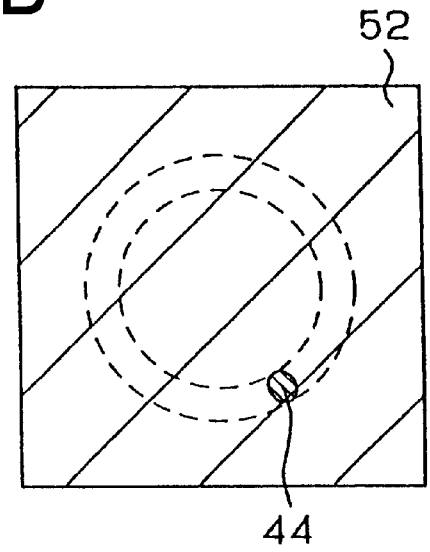
FIG. 4B is a cross-sectional view taken along the line A—A of FIG. 4A.
Figure 5A:
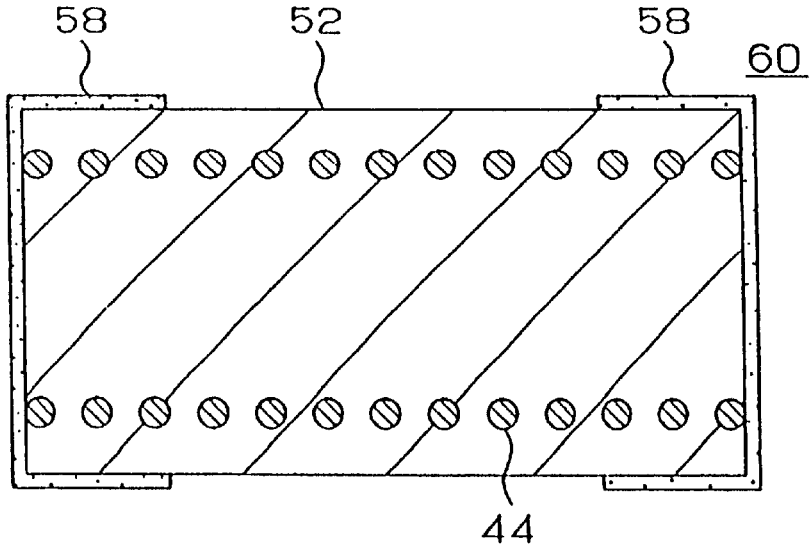
FIG. 5A is a cross-sectional view of a bead inductor produced by the method according to the first preferred embodiment of the present invention.
Figure 5B:
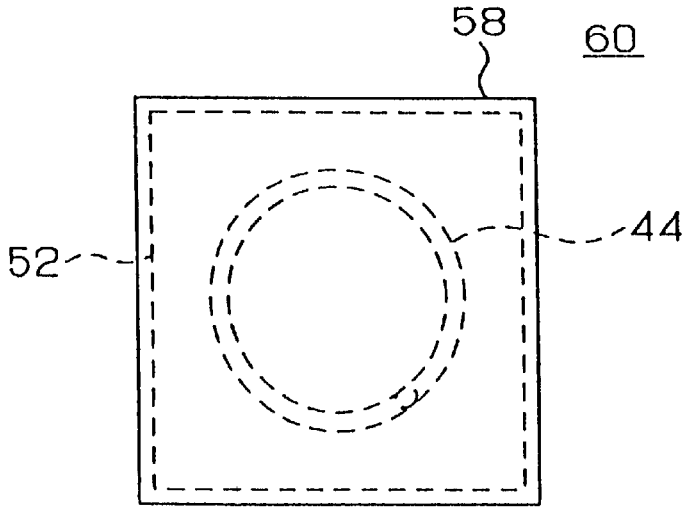
FIG. 5B is a side view of FIG. 5A.

As shown in FIG. 3A, a mold for injection molding 42 to be used in the method of this first preferred embodiment includes an upper mold 42*a* having a cavity 46 and a first lower mold 42*b* with a coil supporting pin 48 arranged to extend upright and coaxially with respect to the cavity 46. A preliminarily produced coil 44 is lifted with the coil supporting pin 48 of the first lower mold 42*b* having the above-mentioned configuration (see FIG. 3B) such that the inner periphery of the coil 44 is in close contact with the coil supporting pin 48. The coil 44 can be produced by, for example, by winding a polyester coated copper line having an approximately 0.8 mm diameter onto a shaft having an approximately 1.8 mm shaft size (diameter) so as to define a coil, and cutting the same into a length including the cutting margin, such as approximately 6 mm each. Then, the upper mold 42*a* is placed onto the first lower mold 42*b* so as to close the cavity 46. Pellets as magnetic chips are supplied from a hopper, or the like, of the injection molding apparatus into a heating cylinder so as to provide a molten resin or synthetic rubber containing magnetic powders (hereinafter referred to as a resin material). The pellets are prepared preferably by kneading an Ni—Cu—Zn containing ferrite as a soft magnetic material in 88% by weight of a PPS (polyphenylene sulfide) resin as an insulating elastic material and forming the same into pellets. The resin material is injected into the cavity 46 via a gate 50 provided in the upper mold 42*a* in a direction that is substantially parallel to the axial direction of the coil supporting pin 48. At the time, the resin material is charged into the space formed with the coil supporting pin 48 and the cavity 46 (primary injection molding). In the primary injection molding, a resin molded product 52 outside of the coil 44 (yoke part) is formed. After hardening the resin molded product 52, the supporting pin 48 is removed from the resin molded product 52 and the first lower mold 42*b* is detached from the upper mold 42*a*. Then, as shown in FIG. 3C, after providing a second lower mold 42*c* without a coil supporting pin 48 for replacement, the same resin material used in the primary injection molding is melted and injected into the space 54 of the resin molded product 52 with the upper mold 42*a* and the second lower mold 42*c* put together via the gate 56 of the second lower mold 42*c* (secondary injection molding). As shown in FIG. 3D, the resin molded product 52 (core part) is formed inside of the coil 44 so that the coil 44 is inserted inside the resin molded product 52. After hardening the resin material injected in the secondary injection molding, the resin molded product 52 molded integrally by the primary injection molding and the secondary injection molding is removed from the cavity 46. The resin molded product 52 having the shape as shown in FIGS. 4A and 4B, removed from the mold for injection molding 42 is cut at both ends in the longitudinal direction at the cutting positions C—C marked with the chained lines in FIG. 4A by a dicing saw so as to have about 4.3 mm length, for example. As a result of the cutting operation, both ends of the coil 44 are exposed on the cut end surfaces of the resin molded product 52. As shown in FIGS. 5A and 5B, both end surfaces of the resin molded product 52 with the end parts of the coil 44 exposed are press-fitted into metal caps 58 defining external terminals. By spot-welding the end parts of the coil 44 and the metal caps 58 over the metal caps 58, the coil 44 and the metal caps 58 are connected electrically so as to provide a bead inductor 60.

According to the method of manufacturing the bead inductor 60 of this preferred embodiment, since the coil 44 is held at the approximate center position of the cavity while being closely fitted with the coil supporting pin 48 arranged to be upright in the lower mold 42*b* at the time of the injection molding, the coil 44 can be inserted at the targeted position (designed position) without the risk of the deformation or crush of the coil 44 or dislocation of the axis position of the coil 44 at the time of injecting the molten resin material from the gate 50. Therefore, in producing a bead inductor 60 using the injection molding method according to this preferred embodiment, unlike the conventional examples, defective products are very rarely if ever produced so that the proportion of the good items to defective items is greatly improved in the inductor production. Moreover, since both ends of the resin molded product 52 are cut after inserting the coil 44, both ends of the coil 44 can be exposed at both end surfaces of the resin molded product 52 for certain, and thus, the electrical connection between the coil 44 and the metal caps 58 can be ensured.

Figure 6A:
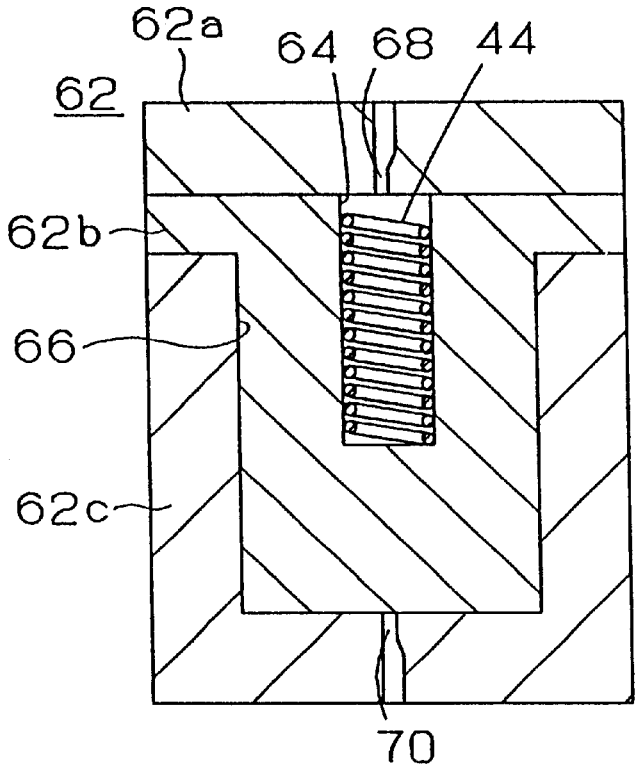
FIG. 6A is a cross-sectional view showing a state at the time of the primary injection molding of a mold used for a method according to a second preferred embodiment of the present invention.

A method of manufacturing an inductor according to another preferred embodiment of the present invention will be explained. As shown in FIG. 6A, a mold for injection molding 62 to be used in this method includes a first lower mold 62*b* having a cavity 64 as a coil supporting member, a second lower mold 62*c* having a cavity 66 for forming the yoke part of the resin molded product 52 and capable of storing the first lower mold 62*b*, and an upper mold 62*a* having a gate 68 for injecting a molten resin material into the cavity 64, to be superimposed onto the first lower mold 62*b*.

Figure 6B:
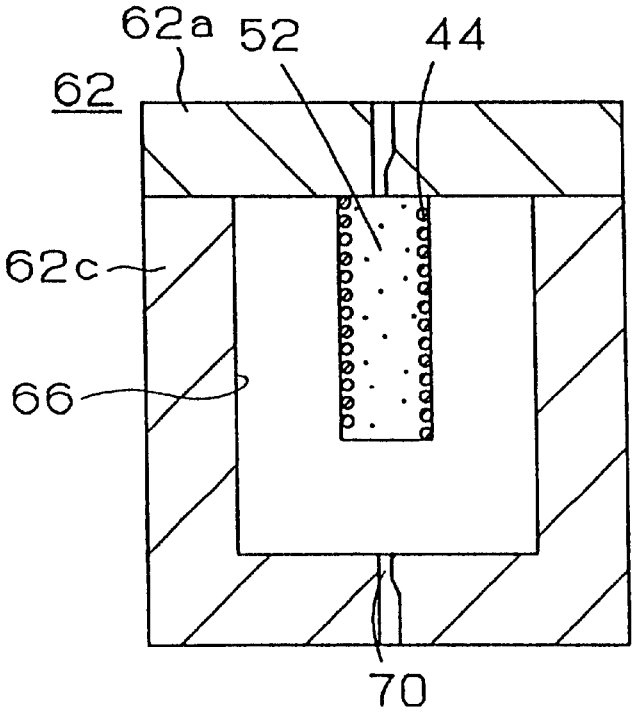
FIG. 6B is a cross-sectional view showing a state at the time of the secondary injection molding of the mold.

With the first lower mold 62*b* with the above-mentioned configuration stored in the cavity 66 of the second lower mold 62*c*, the coil 44 is inserted into the cavity 64 of the first lower mold 62*b* such that the outer periphery of the coil 44 is in close contact with the inner wall surface of the cavity 64. Then, as shown in FIG. 6A, the upper mold 62*a* is placed onto the first lower mold 62*b* so as to close the cavity 64. A molten resin material is charged into the cavity 64 of the first lower mold 62*b* via the gate 68. According to the primary injection molding, the resin molded product 52 of the core part of the coil 44 is formed, and the coil 44 is embedded in the outer periphery part of the resin molded product 52. After hardening the resin molded product 52, the first lower mold 62*b* and the upper mold 62*a* are detached. After removing the first lower mold 62*b*, the upper mold 62*a* is placed onto the second lower mold 62*c* so as to close the cavity 66 as shown in FIG. 6B. At the time, the axial center of the resin molded product 52 held by the lower surface of the upper mold 62*a* and the center of the cavity 66 are arranged coaxially. A molten resin material is charged into the cavity 66 of the second lower mold 62*c* from a gate 70. In the secondary injection molding, the resin molded product 52 of the yoke part of the coil 44 is formed. When the resin material injected in the injection molding is hardened, it is integrated with the resin molded product 52 of the core part formed by the former injection molding. The integrated resin molded product 52 is taken out from the upper mold 62*a* and the second lower mold 62*c*. The resin molded product 52 accordingly formed is cut and attached with the metal caps so as to provide a bead inductor 60 as in the above-mentioned first preferred embodiment (see FIG. 5). The first lower mold 62*b* and the second lower mold 62*c* need not be provided as an insert die as shown in FIG. 6A, but can be used independently. However, since the second preferred embodiment involves a risk of the collapse of the coil 44 in an inward at the time of injecting the resin, the first preferred embodiment is superior thereto for not having the risk.

A method of manufacturing a bead inductor according to the third preferred embodiment of the present invention will be explained with reference to FIG. 7. Similar elements to those of the above-mentioned first preferred embodiment are indicated with the same numerals and further explanation is not provided.

In the above-mentioned first preferred embodiment, the ends of the coil 44 are not deformed by the injection pressure of the molten resin material as long as the coil 44 has a line diameter size that is sufficient for maintaining the coil 44 shape. However, the coil itself can hardly maintain the shape if it has a small line diameter. Therefore, the risk of generating defective items occurs in that the ends of the coil are released in the pre-processing step of mounting the coil 44 onto the coil supporting pin 48 so that the coil 44 cannot be fitted onto the coil supporting pin 48, and so that the end parts of the coil are deformed or the diameter of the coil is expanded by the injection pressure of the molten resin material at the time of the primary injection molding. In the third preferred embodiment, a method that solves the problems in producing a bead inductor having a small diameter coil and not capable of maintaining the coil shape, will be described.

Figure 7:
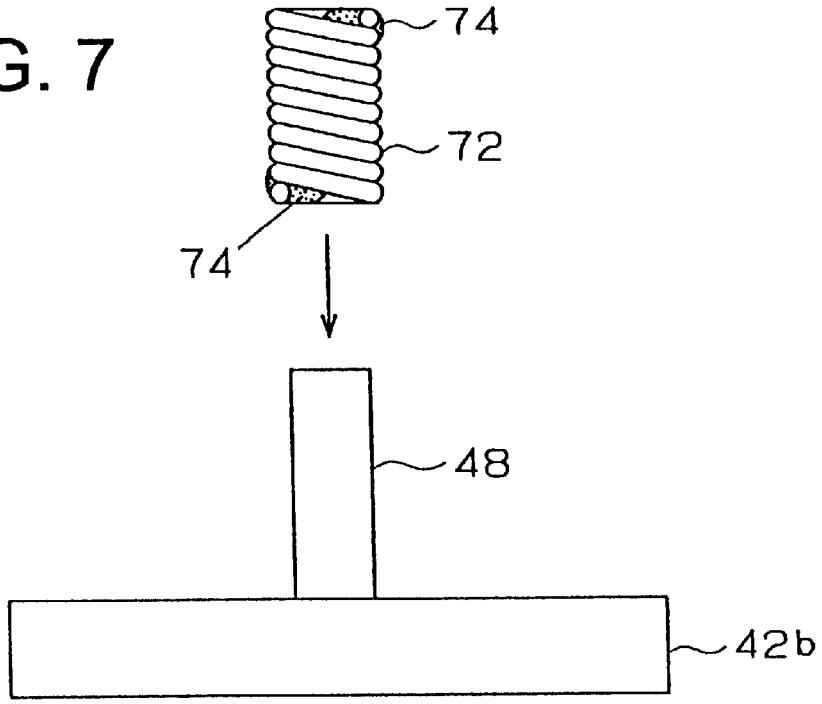
FIG. 7 is a plan view showing a coil to be used in a third preferred embodiment of the present invention.

In this preferred embodiment, before bonding a coil 72 to the coil supporting pin 48, a solder 74 is adhered onto at least one end part of the coil 72 as shown in FIG. 7. Since, in general, the molten resin material is injected from the gate of the upper mold 42*a* (see FIG. 3) along the axial direction of the coil supporting pin 48, only one end part of the coil 72 in the vicinity of the tip of the coil supporting pin 48 needs to be soldered. However, in the case of mounting the coil 72 onto the coil supporting pin 48 by an automatic inserting device, since the coil 72 tends to have an orientation at the time of mounting the coil 72 to the supporting pin 48, the orientation of coils needs to be arranged in order at the time of setting the coils in a part feeder of the automatic inserting device, and thus, it requires labor and very precise positioning. Therefore, in consideration of the operativity, it is preferable to adhere a solder at both end parts of the coil 72. Moreover, the part of the coil 72 to adhere the solder is preferably in a range of at least one round from the end part in consideration of the bonding strength. By fitting the coil 72 with the solder 74 accordingly adhered onto the end part, onto the coil supporting pin 48, placing the upper mold 42*a* onto the first lower mold 42*b* having the upright coil supporting pin 48, and then as in the first preferred embodiment, forming the resin molded product 52, cutting the resin molded product 52, press-fitting the metal caps 58, and electrically connecting the coil 72 and the metal caps 58, a bead inductor 60 can be provided.

According to the above-described third preferred embodiment, since the coil 72 is bonded with the solder 74, problems such as difficulty in maintaining the shape of the coil itself due to a narrow line diameter of the coil, and expansion of the coil diameter or bending of the ends of the coil inwardly so as to prevent fitting with the pin caused by the release of the ends of the coil by the injection pressure of the molten resin material can be solved, and thus generation of defective items is reliably prevented. Furthermore, since the coil 72 is bonded with the solder 74, if the solder 74 is applied beyond the cutting margin in electrically connecting the metal caps 58 as the external terminals and the coil 72 with the solder 74, since the solder 74 remaining on the coil 72 after cutting is melted again, the solder can be provided sufficiently to the metal caps 58 and the coil 72 for ensuring the soldering, and thus the reliability is greatly improved.

Figure 8:
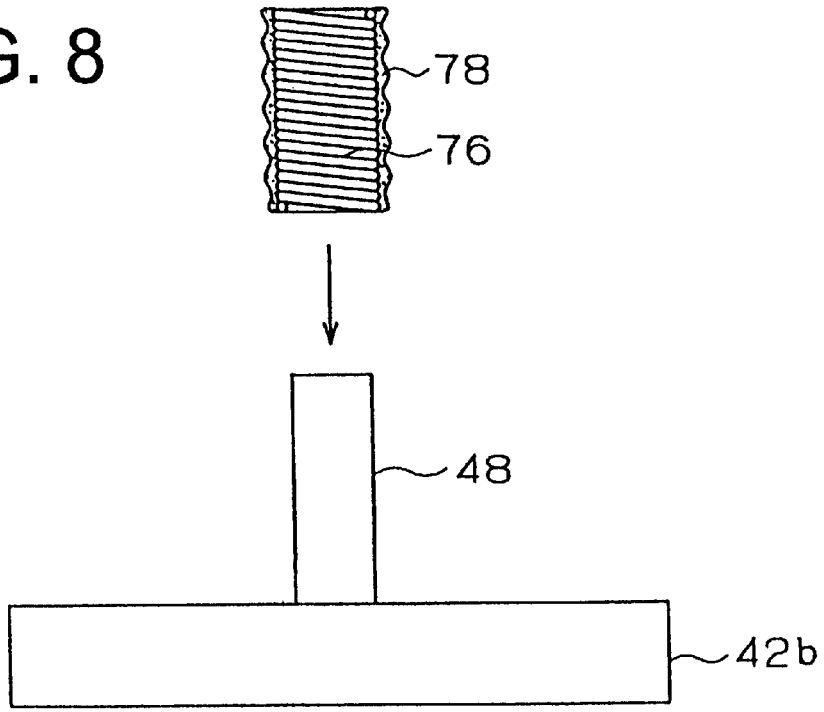
FIG. 8 is a plan view showing a coil to be used in a fourth preferred embodiment of the present invention.

In the case of using a coil having a fine line diameter and which is not capable of maintaining the shape even if both ends are attached with the solder 74 as in the coil 72 shown in FIG. 7, a risk is involved in that the wound line interval may be expanded not only in the ends of the coil, but also in the middle part thereof so as to have irregularity in the winding density of the coil. Therefore, in the preferred embodiment shown in FIG. 8, the entirety of a coil 76 is bonded via a resin 78, such as an adhesive, or the like. By fitting the coil 76 bonded with the resin 78 along the entire length onto the coil supporting pin 48, placing the upper mold 42*a* onto the first lower mold 42*b* having the upright coil supporting pin 48, and then as in the first preferred embodiment, forming the resin molded product 52, cutting the resin molded product 52, press-fitting the metal caps 58, and electrically connecting the coil 76 and the metal caps 58, a bead inductor 60 can be provided.

According to the above-described fourth preferred embodiment, since the coil 76 is bonded along its entire length with the resin 78, problems such as difficulty in maintaining the shape of the coil due to a narrow line diameter of the coil, and expansion of the coil diameter or bending of the ends of the coil inwardly so as to prevent fitting with the pin caused by the release of the ends of the coil due to the injection pressure of the molten resin material, or a problem of changing the characteristics due to the irregularity of the winding density of the coil, are eliminated. Thus, generation of defective items is prevented. Furthermore, by soldering both end parts of the coil 76 as in the above-mentioned preferred embodiment in addition to bonding the coil 76 with the resin 78, the advantages achieved in the third preferred embodiment are also be achieved.

A method of manufacturing a bead inductor according to the fifth preferred embodiment of the present invention will be described with reference to FIGS. 9 and 10. Elements which are the same as those of the preferred embodiments described above are indicated with the same numerals and further explanation is not provided.

In this preferred embodiment, a multi-injection molded product 84 including a plurality of the resin molded products 52 is injection-molded. After cutting the end parts of the multi-injection molded product 84, it is divided into individual resin molded products 52. Compared with the case of cutting the end parts of each resin molded product 52 after dividing into the individual resin molded products 52, the cutting step can be simplified.

Figure 9:
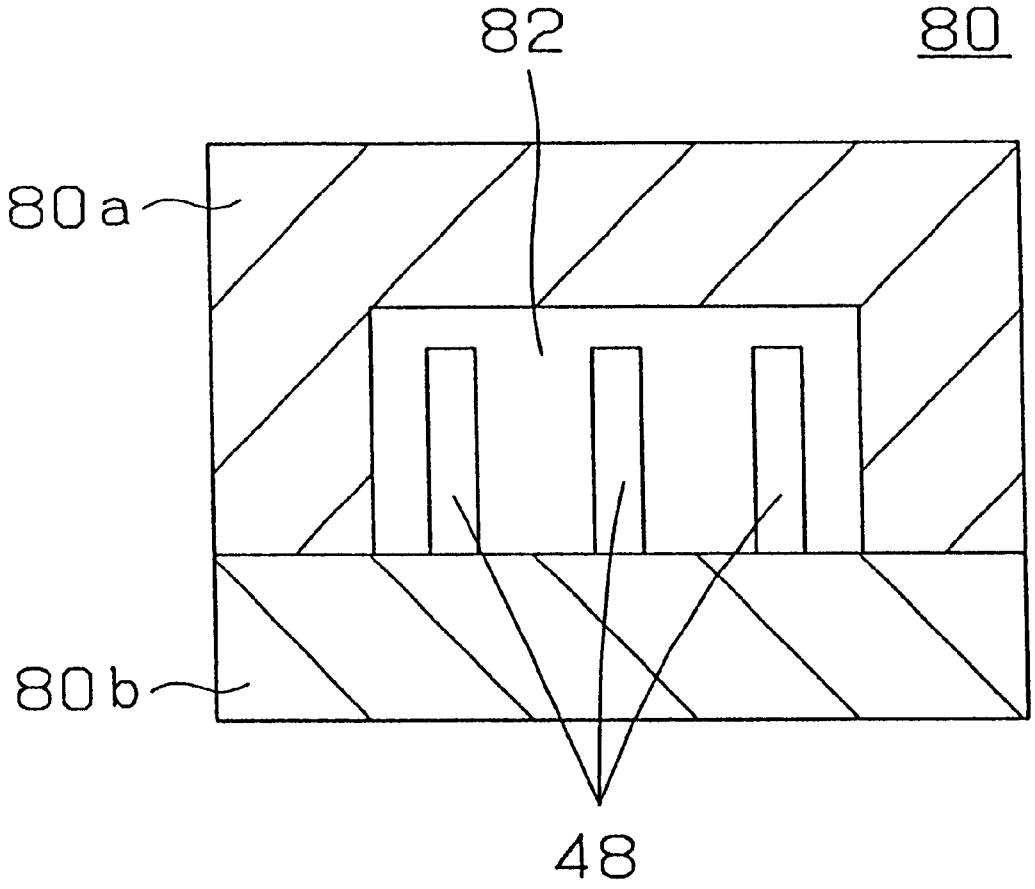
FIG. 9 is a cross-sectional view of a mold for injection molding to be used for a method according to a fifth preferred embodiment of the present invention.
Figure 10:
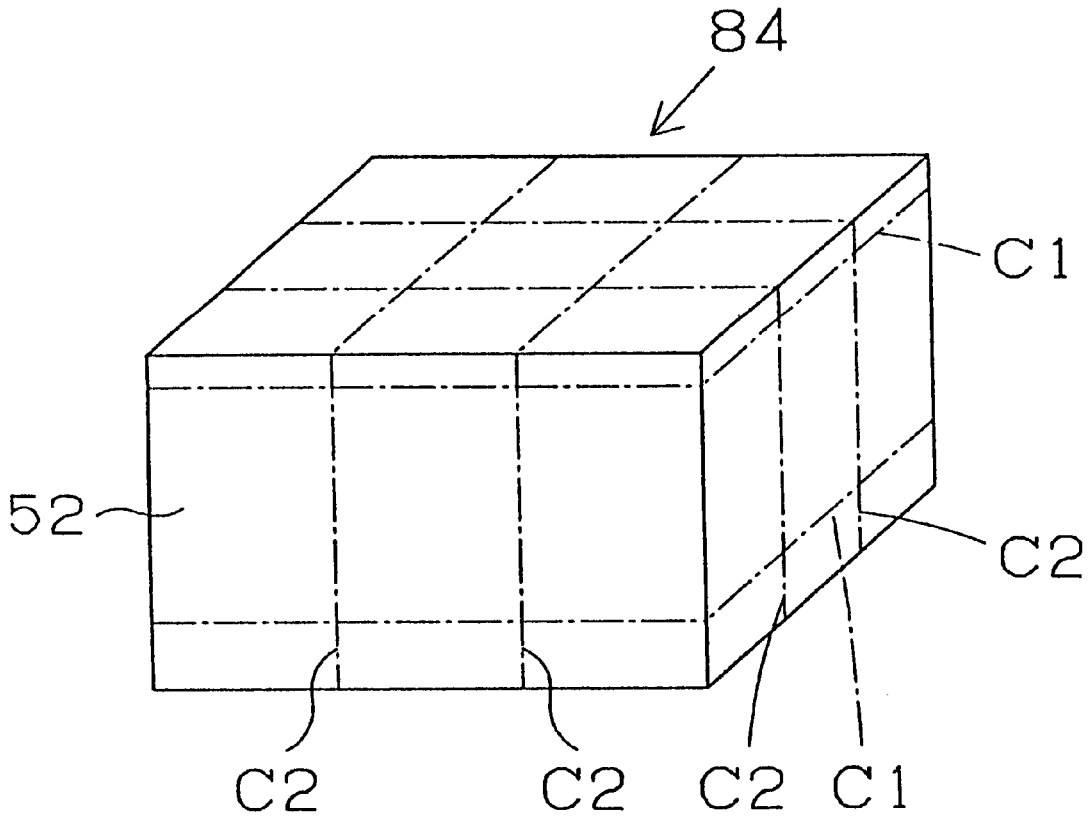
FIG. 10 is a perspective view for explaining the cutting position of a multi-injection molded product according to the fifth preferred embodiment of the present invention.

As shown in FIG. 9, a mold for injection molding 80 to be used in the method of this preferred embodiment includes an upper mold 80*a* having a cavity 82 and a first lower mold 80*b*, with the upper surface of the first lower mold 80*b* provided with a plurality of the upright coil supporting pins 48 extending in the axial direction thereof and substantially parallel with each other, corresponding with the cavity 82. To each of the coil supporting pins 48 of the first lower mold 80*b* with the above-mentioned configuration, either of the coils 44, 72, 76 used in the first to the fourth preferred embodiments is closely fitted. Then, the upper mold 80*a* is placed onto the first lower mold 80*b*. Then, by conducting the primary injection molding and the secondary injection molding, the multi-injection molded product 84 shown in FIG. 10 is produced. The produced multi-injection molded product 84 is cut by a slicing machine at the cutting positions C1 shown by the chain lines in the vicinity of the upper and lower end surfaces in FIG. 10 for exposing both ends of the coils 44, 72, 76. Both ends of the coils 44, 72, 76 are exposed on the cut upper and lower end surfaces of the multi-injection molded product 84 by cutting. Then, in order to divide the multi-injection molded product 84 into a plurality of the resin molded products 52, the product 84 is cut via a dicing saw at cutting positions C2 shown by the chain lines to provide the individual resin molded products 52. As in the above-described preferred embodiments, both end parts of the resin molded products 52 are press-fitted with the metal caps 58, and furthermore, the coils 44, 72, 76 and the metal caps 58 are connected electrically so as to provide bead inductors 60.

According to the method of manufacturing a bead inductor of this preferred embodiment, since a plurality of the resin molded products 52 are produced with one mold for injection molding 80, the production process is extremely efficient and the mass productivity is greatly improved. Moreover, as to the cutting step, since both end parts of a plurality of the coils are exposed in one operation, the number of operations is significantly reduced.

Hereinafter, a method of manufacturing a bead inductor according to the sixth preferred embodiment of the present invention will be explained with reference to FIGS. 11 and 12. Elements which are the same as those of the above-described preferred embodiments are indicated using the same numerals and further explanation is not provided.

In this preferred embodiment, a multi-layer multi-injection molded product 90 having a configuration wherein the multi-injection molded product 84 produced in the fifth preferred embodiment laminated in layers is formed so as to further improve the mass productivity including the efficiency in the cutting step as a post-production step.

Figure 11A:
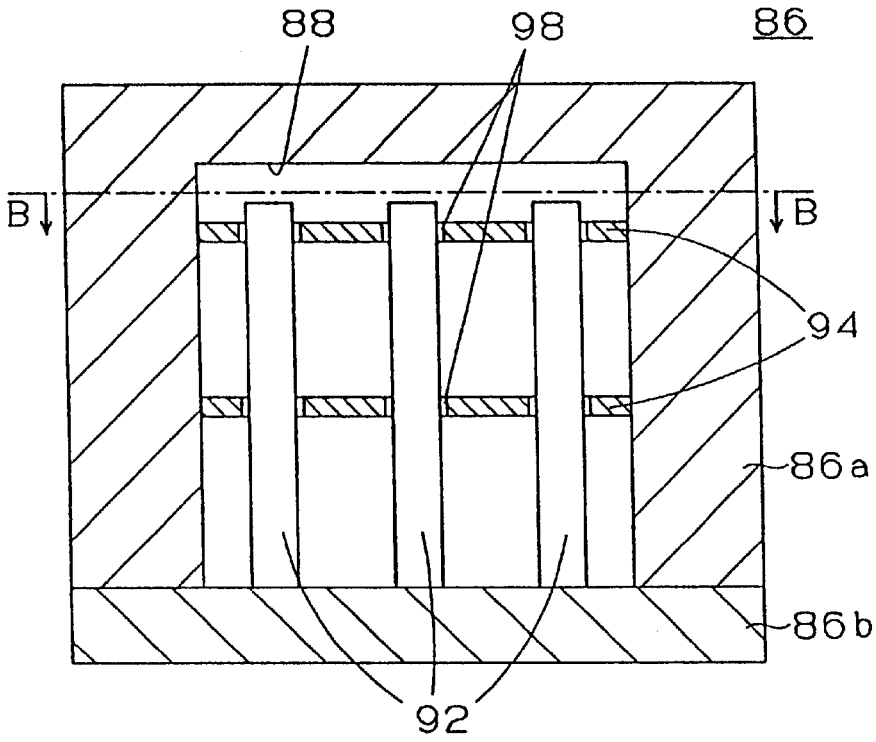
FIG. 11A is a cross-sectional view of a mold for injection molding to be used in a method according to a sixth preferred embodiment of the present invention.
Figure 11B:
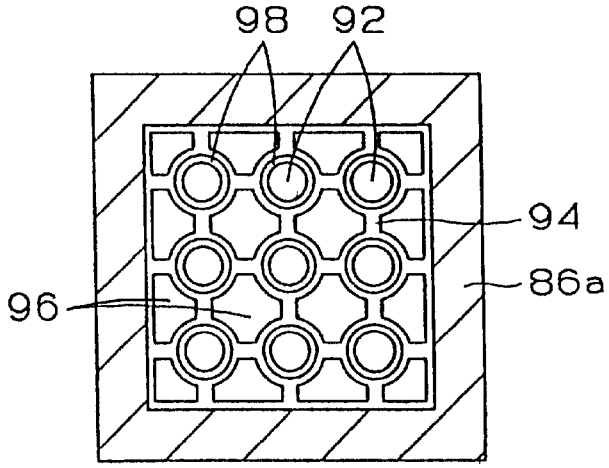
FIG. 11B is a cross-sectional view taken along the line B—B of FIG. 11A.
Figure 12:
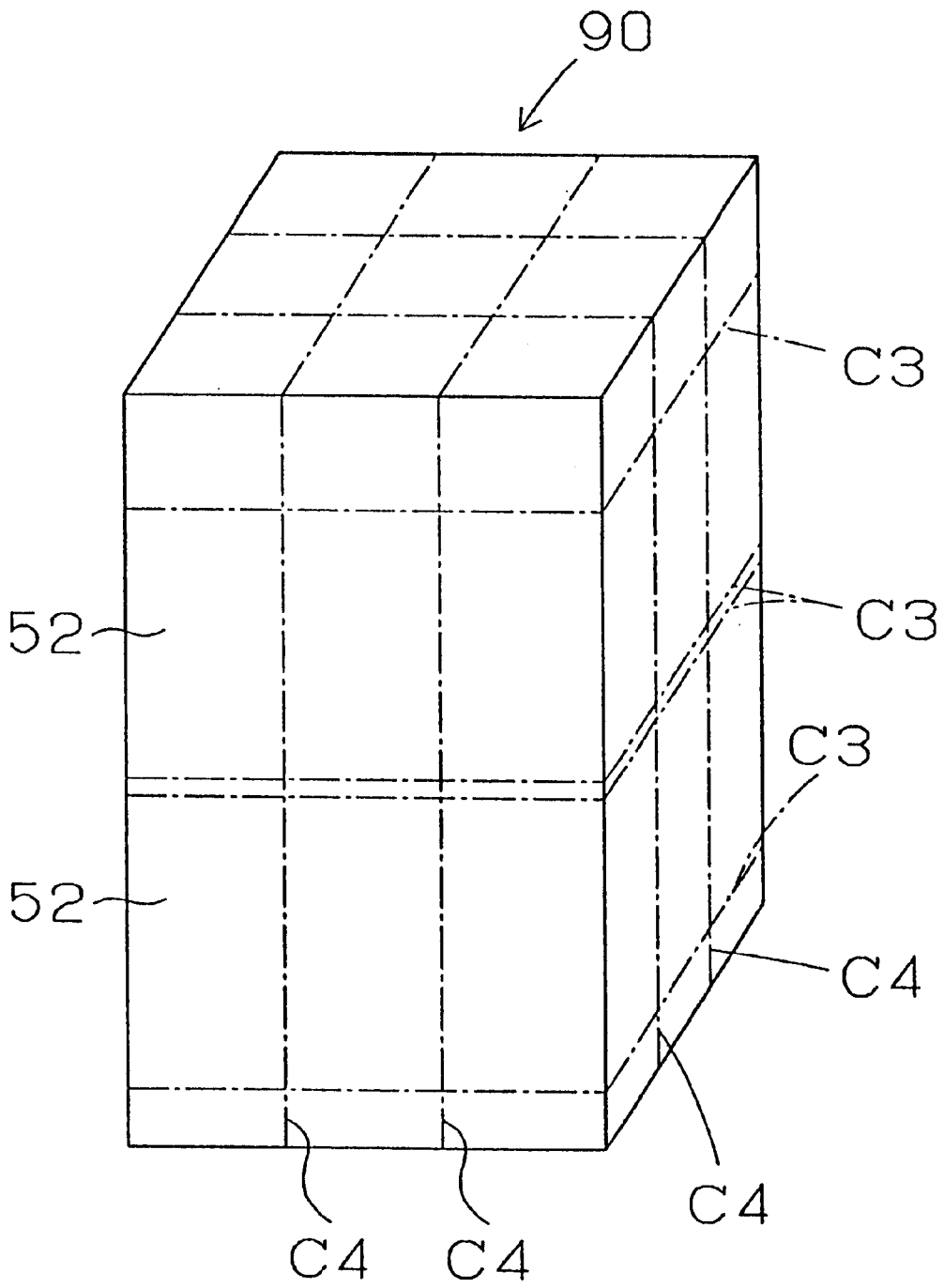
FIG. 12 is a perspective view for explaining the cutting position of a multi-injection molded product according to the sixth preferred embodiment of the present invention.

As shown in FIG. 11, a mold for injection molding 86 to be used in the method of this preferred embodiment includes an upper mold 86*a* having a cavity 88 and a first lower mold 86*b* with a plurality of upright coil supporting pins 92 provided with the axial direction thereof arranged substantially parallel with each other, corresponding with the cavity 88. The coil supporting pins 92 have a length sufficient for supporting a long coil 44, 72, 76 having a length suitable for a plurality components thereof while being fitted with the long coil 44, 72, 76. The coils 44, 72, 76 are fitted onto each of the coil supporting pins 94 of the first lower mold 86*b* having the above-mentioned configuration. As shown in FIG. 11A, by placing the upper mold 86*a* onto the first lower mold 86*b*, and conducting the primary injection molding and the secondary injection molding, the multi-layer multi-injection molded product 90 as shown in FIG. 12 is produced. The multi-layer multi-injection molded product 90 thus produced is cut by a slicing machine at cutting positions C3 shown by the chain lines in the vicinity of the upper and lower end surfaces and substantially parallel with the upper and lower end surfaces at the approximate center part in the longitudinal direction in FIG. 12 into individual multi-injection molded products 84 having about 4.3 mm length for exposing both ends of the coils 44, 72, 76. According to the cutting operation, both ends of the coils 44, 72, 76 are exposed on the cut end surfaces of the multi-injection molded products 84 formed in each layer. In order to divide the plurality of the multi-injection molded products 84 into individual resin molded products 52, they are cut by a dicing saw at cutting positions C4 shown by the chain lines. Then, as in the above-described preferred embodiments, the resin molded products 52 are press-fitted with the metal caps 58, and the coils 44, 72, 76 and the metal caps 58 are connected electrically so as to define bead inductors 60.

If the diameter of the coil supporting pins 92 is small, the coil supporting pins 92 may be bent by the injection pressure at the time of injecting the molten resin material, resulting in generation of defective items of the resin molded products 52. In this case, in order to prevent the bend or dislocation of the coil supporting pins 92, pin supporting members 94 can be arranged horizontally in the cavity 88 at the positions of cutting the coils 44, 72, 76 and the resin molded products 52 as shown in FIG. 11B. The pin supporting members 94 are provided with a large number of comparatively large openings 96 for allowing the smooth passage of the resin without weakening the injection property of the resin. Furthermore, gaps 98 are provided between the coil supporting pins 92 and the pin supporting members 94 for fitting the coils 44, 72, 76 so that the coil supporting pins 92 are supported by the pin supporting members 94 via the coils 44, 72, 76 fitted in the gaps 98. The pin supporting members 94 are disposed at a position corresponding with the area to be cut for exposing the end parts of the coils 44, 72, 76. At the time of cutting out the multi-injection molded products 84, the multi-layer multi-injection molded product 90 is cut at the upper and lower cutting positions C3 interposing the pin supporting members 94 so as to eliminate the pin supporting members 94 as shown in FIG. 12.

According to the method of manufacturing a bead inductor of this preferred embodiment, since a plurality of the resin molded products 52 can be produced in multi-layers using only one mold 86, the production process is even more efficient and the mass productivity is even more improved compared with the third preferred embodiment. Moreover, as to the cutting step, since both end parts of the coils can be exposed in one cutting operation, the operation is very efficient. Furthermore, by providing the pin supporting members 94 for preventing the bend and the dislocation of the coil supporting pins 92 and the dislocation of the coils 44, 72, 76, the positioning accuracy of the coils 44, 72, 76 is greatly improved.

Hereinafter, a method of manufacturing a bead inductor according to the seventh preferred embodiment of the present invention will be described with reference to FIG. 13. Elements which are the same as those of the above-described preferred embodiments are indicated with the same numerals and further explanation is not provided.

In this preferred embodiment, in producing a plurality of the resin molded products 52 in one injection molding as in the above-mentioned third and fourth preferred embodiments, a marker is provided for indicating the cutting position for improving the operation efficiency in the cutting step and improving the size accuracy of each resin molded product 52. Explanation will be provided for this preferred embodiment based on the mold for injection molding 80 of the third preferred embodiment shown in FIG. 9.

Figure 13A:
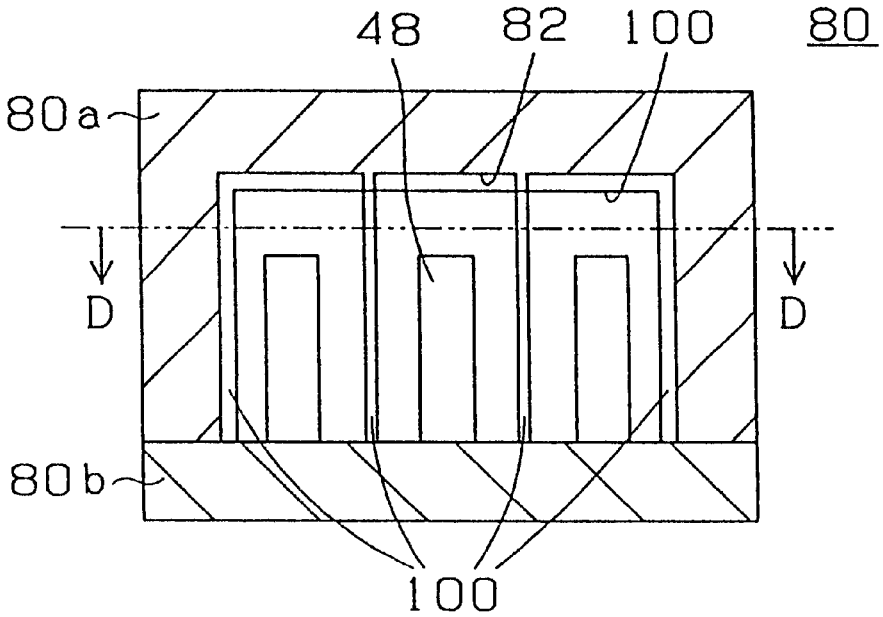
FIG. 13A is a cross-sectional view of a mold for injection molding to be used in a method according to a seventh preferred embodiment of the present invention.
Figure 13B:
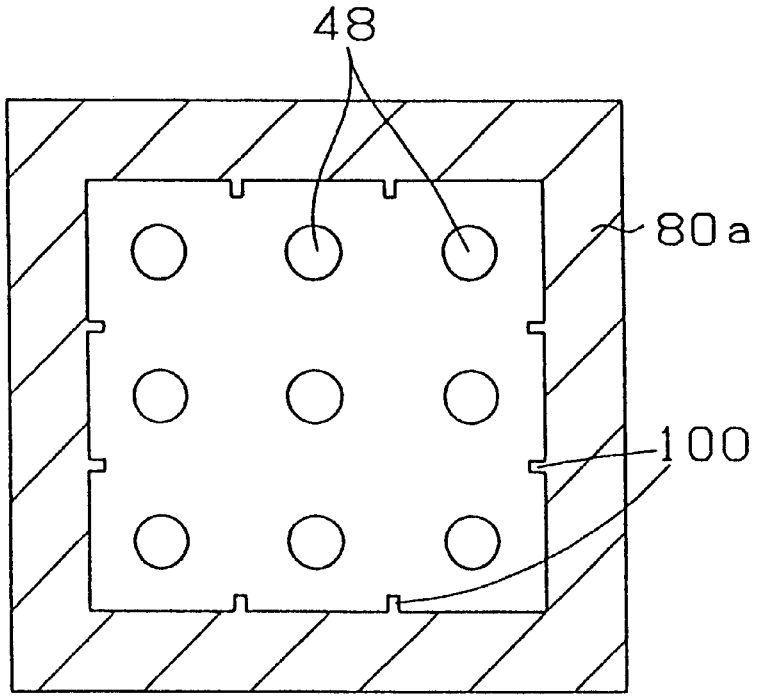
FIG. 13B is a cross-sectional view taken on the line D—D of FIG. 13A.

According to the method of this preferred embodiment, as shown in FIG. 13, projections 100 are provided as the marking parts at a position to be the cutting margin, corresponding with the cutting position on the inner periphery surface of the cavity 82 of the upper mold 80*a*. Therefore, grooves (not illustrated) are formed at a part corresponding with the cutting position in a multi-injection molded product 84 which is injection-molded with the upper mold 80*a*.

According to the method of the above-mentioned preferred embodiment, since the grooves are formed in the multi-injection molded product 84 so as to indicate the target of the cutting position, a slicing machine or a dicing saw can be positioned easily in the cutting step so as to improve the operation efficiency and the size accuracy of each resin molded product 52.

Although projections 100 are provided on the wall surface of the cavity 82 of the upper mold 80*a* in this preferred embodiment, the location is not limited thereto. A groove, or anything to serve as a marker for indicating the cutting position on the multi-injection molded product 84 can be provided instead.

While the invention has been particularly shown and described with reference to preferred embodiments thereof, it will be understood by those skilled in the art that the foregoing and other changes in form and details may be made therein without departing form the spirit and scope of the invention.

What is claimed is:

1. A method of manufacturing an inductor having a conductor coil embedded in a magnetic chip containing a magnetic material, with an external terminal electrode electrically connected to the conductor coil on the outer surface of the magnetic chip, the method comprising the steps of:

holding the conductor coil in a cavity of a mold for injection molding by fitting the conductor coil to a coil supporting member provided in the cavity such that the coil supporting member contacts substantially the entire length of the conductor coil;

performing a primary injection molding by injecting a molten magnetic chip molding material into the cavity;

performing a secondary injection molding by removing the coil supporting member from the cavity and injecting a molten magnetic chip molding material into a space in the cavity which was occupied by the coil supporting member so as to define a molded product having the conductor coil embedded therein;

removing the molded product having the conductor coil embedded therein from the mold; and cutting the molded product so as to expose end parts of the embedded conductor coil.

2. The method according to claim 1, wherein the coil supporting member has a rod shape and protrudes in an axial direction of the cavity.

3. The method according to claim 1, wherein the conductor coil is held by the coil supporting member such that at least one end part of the conductor coil is temporarily attached to the conductor coil supporting member during the step of the primary injection molding.

4. The method according to claim 1, wherein the end parts of the embedded conductor coils are exposed by cutting the molded product and the conductor coils are separated individually after producing the molded product so as to have a plurality of the conductor coils insert-molded in the magnetic chip molding material via the steps of the primary injection molding and the secondary injection molding.

5. The method according to claim 1, wherein the molded product is cut so as to divide the conductor coil which has a length sufficient for a plurality of inductors into a length sufficient for one inductor after obtaining a molded product in which the conductor coil has a length suitable for a plurality of inductors, embedded in the magnetic chip by the steps of the primary injection molding and the secondary injection molding.

6. The method according to claim 5, wherein a coil supporting member for holding the conductor coil having a length suitable for a plurality of inductors is provided in the primary injection molding and a member for supporting the conductor coil fitted onto the coil supporting member is provided at a position to define a cutting margin of the molded product having the conductor coil embedded therein.

7. The method according to claim 5, wherein a coil supporting member for holding the conductor coil having a length suitable for a plurality of inductors is provided in the primary injection molding and a member for supporting the coil supporting member is provided at a position to define a cutting margin of the molded product having the conductor coil embedded therein.

8. The method according to claim 1, wherein a marking part for providing a mark of the position to define the cutting margin of the molded product on an outer surface of the molded product is provided on an inner surface of the cavity of the mold.

9. A method of manufacturing an inductor having a conductor coil embedded in a magnetic chip containing a magnetic material, with an external terminal electrode electrically connected to the conductor coil on the outer surface of the magnetic chip, the method comprising the steps of:

holding the conductor coil in a cavity for injection molding including a coil supporting member such that the coil supporting member contacts substantially the entire length of the conductor coil;

performing a primary injection molding by injecting a molten magnetic chip molding material into the cavity for injection molding including the coil supporting member so as to define a molded product having the conductor coil embedded therein;

performing a secondary injection molding by removing the molded product having the coil conductor embedded therein from the coil supporting member so as to be placed in a cavity of a mold from injection molding and injecting a molten magnetic chip molding material into a space in the cavity of the mold which was occupied by the coil supporting member;

removing the molded product with the conductor coil embedded therein from the mold; and cutting the molded product so as to expose end parts of the embedded conductor coil.

10. The method according to claim 9, wherein the coil supporting member has a rod shape and protrudes in an axial direction of the cavity.

11. The method according to claim 9, wherein the conductor coil is held by the coil supporting member such that at least one end part of the conductor coil is temporarily attached to the conductor coil supporting member during the step of the primary injection molding.

12. The method according to claim 9, wherein the end parts of the embedded conductor coils are exposed by cutting the molded product and the conductor coils are separated individually after producing the molded product so as to have a plurality of the conductor coils insert-molded in the magnetic chip molding material via the steps of the primary injection molding and the secondary injection molding.

13. The method according to claim 9, wherein the molded product is cut so as to divide the conductor coil which has a length sufficient for a plurality of inductors into a length sufficient for one inductor after obtaining a molded product in which the conductor coil has a length suitable for a plurality of inductors, embedded in the magnetic chip by the steps of the primary injection molding and the secondary injection molding.

14. The method according to claim 9, wherein a coil supporting member for holding the conductor coil having a length suitable for a plurality of inductors is provided in the primary injection molding and a member for supporting the conductor coil fitted onto the coil supporting member is provided at a position to define a cutting margin of the molded product having the conductor coil embedded therein.

15. The method according to claim 14, wherein a coil supporting member for holding the conductor coil having a length suitable for a plurality of inductors is provided in the primary injection molding and a member for supporting the coil supporting member is provided at a position to define a cutting margin of the molded product having the conductor coil embedded therein.

16. The method according to claim 9, wherein a marking part for providing a mark of the position to define the cutting margin of the molded product on an outer surface of the molded product is provided on an inner surface of the cavity of the mold.

17. A method of manufacturing an inductor, comprising the steps of:

providing a mold for injection molding including a cavity having a coil support;

disposing a conductor coil in contact with the coil support such that the coil support contacts substantially the entire length of the coil conductor;

performing a first step of injection molding by injecting a molding material into the cavity of the mold;

removing the coil support from the cavity;

performing a second step of injection molding by injecting a molding material into a space in the cavity which was occupied by the coil support so as to define a molded product having the conductor coil embedded therein;

removing the molded product having the conductor coil embedded therein from the mold; and cutting the molded product so as to expose end parts of the embedded conductor coil.

18. The method according to claim 17, wherein the coil support has a rod shape.

19. The method according to claim 17, wherein the coil support protrudes in an axial direction of the cavity.

20. The method according to claim 17, wherein the conductor coil is held by the coil support such that at least one end part of the conductor coil is temporarily attached to the coil support during the first step of injection molding.

* * * * *